US006155312A

United States Patent [19]

Bosy

[11] Patent Number: 6,155,312

[45] Date of Patent: Dec. 5, 2000

[54] FLUID DISPENSING DEVICE AND METHOD

[75] Inventor: Brian J. Bosy, Framingham, Mass.

[73] Assignee: The Gillette Company, Boston, Mass.

[21] Appl. No.: 09/310,816

[22] Filed: May 12, 1999

[51] Int. Cl.[7] ..... B65B 1/04; B65B 3/04

[52] U.S. Cl. ..... 141/2; 141/4; 141/5; 141/18; 141/20.5; 141/250; 141/263; 141/284; 141/374

[58] Field of Search ..... 141/2, 4, 5, 18, 141/20.5, 250, 251, 263, 270, 275, 284, 374

[56] References Cited

U.S. PATENT DOCUMENTS

| | | | |
|---|---|---|---|
| 2,144,628 | 1/1939 | Mothersall | 226/97 |
| 3,315,437 | 4/1967 | Henriksen | 53/37 |
| 3,402,857 | 9/1968 | Ecklund et al. | 222/189 |
| 3,559,702 | 2/1971 | Riesenberg | 141/128 |
| 3,620,264 | 11/1971 | Klein | 141/1 |
| 3,626,998 | 12/1971 | Trusselle | 141/198 |
| 3,800,496 | 4/1974 | Bardet | 53/64 |
| 3,900,268 | 8/1975 | Bok | 401/230 |
| 4,232,702 | 11/1980 | Geil | 137/115 |
| 4,272,772 | 6/1981 | Geil | 346/140 |
| 4,305,701 | 12/1981 | Geil | 417/307 |
| 5,341,162 | 8/1994 | Hermanson et al. | 347/92 |
| 5,588,471 | 12/1996 | Lowe | 141/83 |
| 5,592,201 | 1/1997 | Lim | 347/30 |
| 5,691,753 | 11/1997 | Hilton | 347/85 |
| 5,720,326 | 2/1998 | Kaneko | 141/114 |

*Primary Examiner*—Henry J. Recla
*Assistant Examiner*—Timothy L. Maust
*Attorney, Agent, or Firm*—Fish & Richardson P.C.

[57] ABSTRACT

Methods and devices for dispensing fluids are provided, including a method of dispensing a fluid into an elongated chamber having a bottom that is at least partially closed. The method includes (a) inserting a dispensing tube into the chamber until a delivery end of the tube is adjacent the bottom of the chamber; (b) dispensing a predetermined quantity of the fluid through the delivery end into the chamber; and (c) moving the delivery end away from the bottom of the chamber, during dispensing, at a rate that maintains the delivery end on the surface of the fluid in the chamber throughout dispensing.

21 Claims, 5 Drawing Sheets

FLUID DISPENSING DEVICE AND METHOD

BACKGROUND OF THE INVENTION

The present invention relates to devices and methods for minimizing air entrapment when dispensing fluids, more particularly for dispensing fluids into small diameter, elongated reservoirs.

When a fluid is dispensed into a small diameter tube, such as the reservoir of a pen, the relatively small clearance between the filling tube and the wall of the reservoir will in some cases tend to cause the fluid to rush up the sides of the reservoir, fouling the filling tube. In other cases, turbulence in the fluid may cause air to be incorporated into the fluid. Additionally, the fluid may not reach the bottom of the tube, leaving an air pocket in the bottom of the tube.

In the case of filling ink into a pen reservoir, if this air pocket is at the writing end of the pen it may prevent the pen from functioning. The air entrained in the ink can also have a deleterious effect on pen performance. Therefore, it is often necessary to centrifuge the filled pens to remove entrapped air. Ball point pens are often manufactured by filling the pen reservoir completely, with the tip area of the pen open, and centrifuging the pen prior to applying the ball point.

SUMMARY OF THE INVENTION

Applicants have discovered methods by which air entrainment and entrapment can be minimized when fluids are dispensed into small diameter tubes. These methods allow inks to be filled into ball point pens without the need to subsequently centrifuge the pens.

In one aspect, the invention features a method of dispensing a fluid into an elongated chamber having a bottom that is at least partially closed. The method includes: (a) inserting a dispensing tube into the chamber until a delivery end of the tube is adjacent the bottom of the chamber; (b) dispensing a predetermined quantity of the fluid through the delivery end into the chamber; and (c) causing the delivery end to move away from the bottom of the chamber, during dispensing, at a rate that maintains the delivery end on or slightly above the surface of the fluid in the chamber throughout dispensing. The inventor has found that it is important that the tube remain on or slightly, e.g., less than 0.5 mm, above the surface of the fluid throughout dispensing. If the tube is allowed to sink below the surface of the fluid, the fluid will tend to rush up the sides of the chamber, causing the tube to become smeared with ink, which generally results in production problems. Conversely, if the tube is allowed to rise significantly above the surface of the fluid, air pockets will be formed and/or air will be incorporated into the fluid.

Preferred embodiments of this aspect of the invention include one or more of the following features. The chamber is cylindrical, and has a diameter of less than about 10 mm, more preferably about 1 to 5 mm. The diameter of the tube is at least 70% of that of the chamber, and is typically at least 90% of that of the chamber. The method further includes degassing the fluid prior to dispensing. The fluid is an ink or correction fluid. The fluid is a ball point pen ink. The delivery end of the tube contacts the bottom of the chamber in step (a). The chamber is the reservoir of a ball point pen and the bottom of the chamber is defined by the ball of the ball point.

In another aspect, the invention features a method of dispensing a fluid into the reservoir of a writing instrument having a first end and a writing tip adjacent and in fluid communication with the first end, during manufacture of the writing instrument. The method includes the sequential steps of: (a) inserting a dispensing tube into the reservoir until a delivery end of the dispensing tube is adjacent the first end of the reservoir; and (b) dispensing a predetermined quantity of the fluid through the delivery end of the dispensing tube into the reservoir. Using this method, a fluid can be dispensed directly into a writing instrument having a writing tip (rather than applying the tip after dispensing), without the formation of an air pocket in the reservoir (thus eliminating the need to centrifuge the writing instrument).

Preferred embodiments of this aspect of the invention include one or more of the following features. The method further includes degassing the fluid prior to the dispensing step. The first end of the writing instrument includes a ball point. The delivery end of the dispensing tube contacts the ball of the ball point during the inserting step. The method further includes causing the delivery end to move away from the first end of the reservoir during dispensing, preferably at a rate that maintains the delivery end on the surface of the fluid in the reservoir throughout the dispensing step. The fluid is an ink or correction fluid.

The term "tube", as used herein, includes needles, tubes, and other suitable elongated members having a bore through which the fluid may be delivered.

The term "writing instrument", as used herein, includes pens for use in delivering inks or correction fluids by writing on a substrate.

The phrase "causing the delivery end to move" means that the delivery end can be moved relative to the reservoir, or the reservoir can be moved relative to the delivery end, or both delivery end and reservoir can be moved.

Other features and advantages of the invention will be apparent from the drawings, the following Detailed Description, and the claims.

DESCRIPTION OF THE PREFERRED EMBODIMENTS

Figure 1:
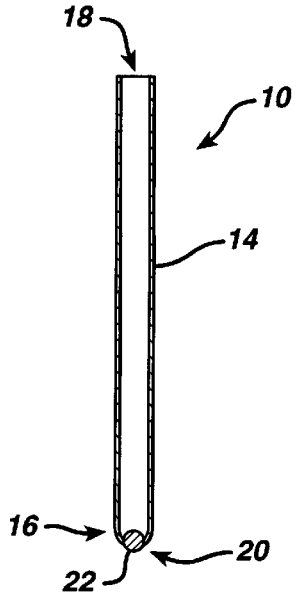
FIGS. 1–1*e* are schematic side views, in partial cross-section, showing a method for dispensing ink into a ball point pen, according to one aspect of the invention.
Figure 1A:
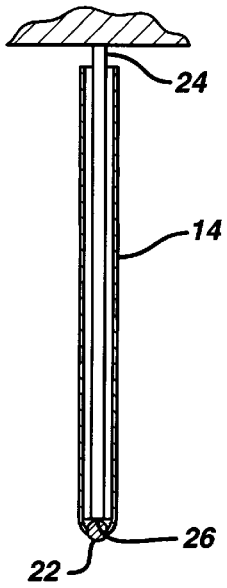
Figure 1B:
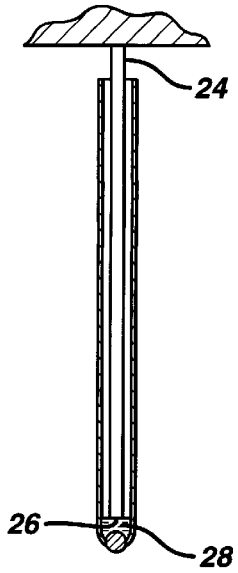
Figure 1C:
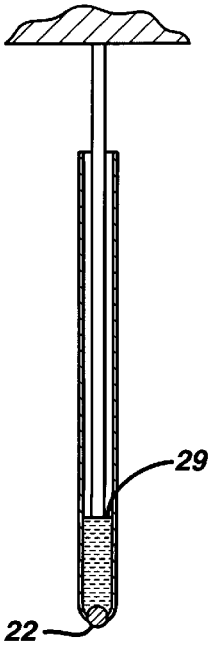
Figure 1D:
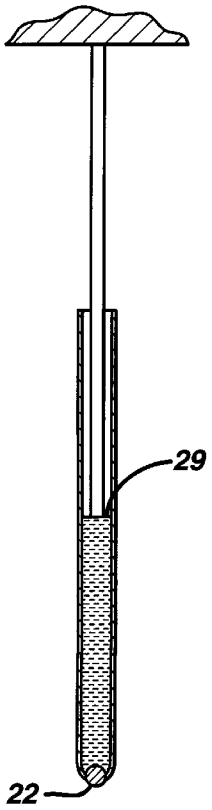
Figure 1E:
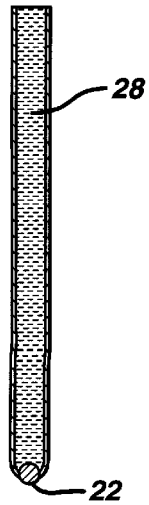

A preferred method of dispensing a viscous ball point pen ink into a ball point pen is shown in FIGS. 1–1*e*.

As shown in FIG. 1, a ball point pen refill 10 includes an empty reservoir 14 and a ball point 16 disposed at one end of reservoir 14. Reservoir 14 is open at end 18, opposite the ball point, and is closed at the opposite end 20 by a ball 22. Reservoir 14 typically has a diameter of from about 2 to 5 mm, narrowing to about 0.5 to 1.0 mm at the ball point 16, and a length of from about 3 to 5 inches. The reservoir is typically formed of metal or plastic. The ball is typically formed of tungsten carbide and has a diameter of from about 0.8 to 1.0 mm.

First, a dispensing tube 24 is inserted through open end 18 into the reservoir 14, as shown in FIG. 1*a*. (For clarity, the tube is not shown in cross-section in FIGS. 1*a*–1*c*.) The dispensing tube is inserted completely into the reservoir, until the delivery end 26 of the dispensing tube 24 is as close as possible to the ball 22 at closed end 20. (Because of the taper of the reservoir at the ball point 16 the tube may be too large to be inserted all the way to the closed end 20.)

Next, as shown in FIG. 1*b*, a fluid 28 is introduced into the fluid by the dispensing tube 24. Preferably, this initial introduction is under pressure, to force out any air in the space between the delivery end 26 and the closed end 20. Then, as shown in FIGS. 1*c*–1*d*, fluid 28 is dispensed through the delivery end 26 at a predetermined rate, while delivery end 26 is simultaneously raised (or the reservoir is lowered relative to the delivery end 26) at a rate selected to allow the delivery end to remain on or slightly above the surface 29 of the fluid throughout dispensing. Suitable dispensing rates are from 0.1 $in^3$/sec to 1.0 $in^3$/sec, and suitable rates for moving the delivery end are from about 100 to 300 inches/second, with the balance of dispensing rate to movement rate being determined so as to minimize turbulence of the fluid.

Finally, when a desired amount of the fluid has been dispensed, dispensing is stopped and the dispensing tube is removed from the reservoir (FIG. 1*e*). The open end 18 of the reservoir is then capped, and the pen is ready for use, without the need for centrifugation.

Suitable inks for use in the ball point pen 10 include any ball point pen inks. Preferred ball point pen inks typically have viscosities of from about 5,000 to 20,000 cps (Brookfield viscosity at 25° C.).

Figure 2:
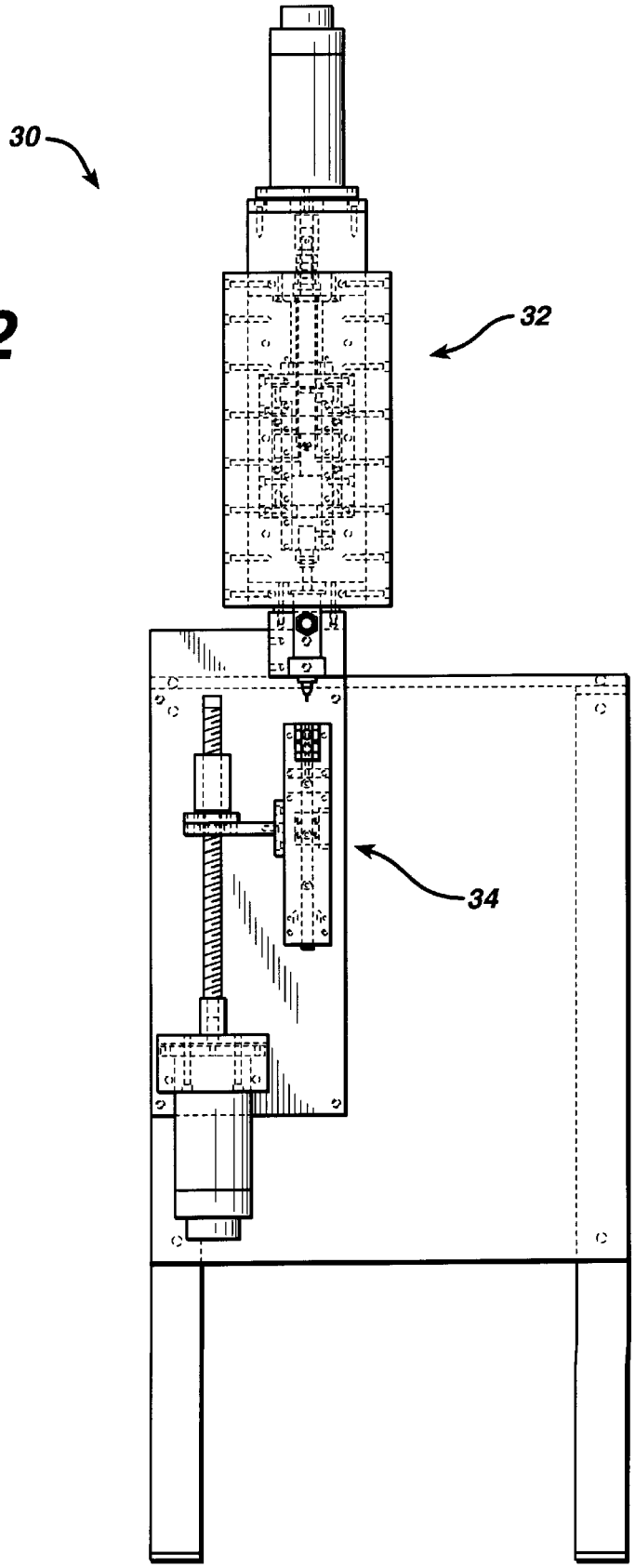
FIGS. 2 and 2*a* are a planar front view and a planar side view, respectively, of a device for dispensing ink according to one aspect of the invention.
Figure 2A:
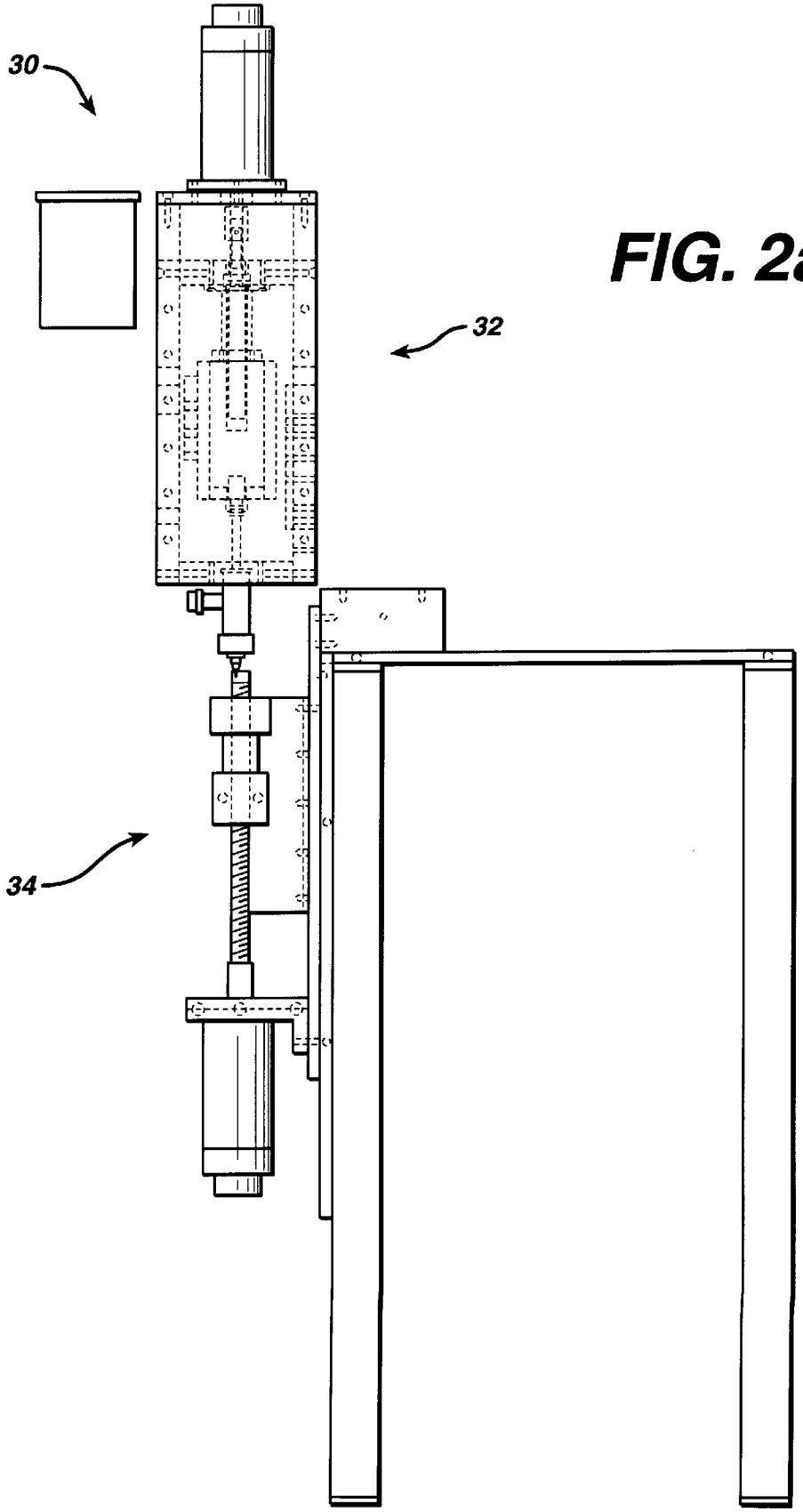
Figure 2B:
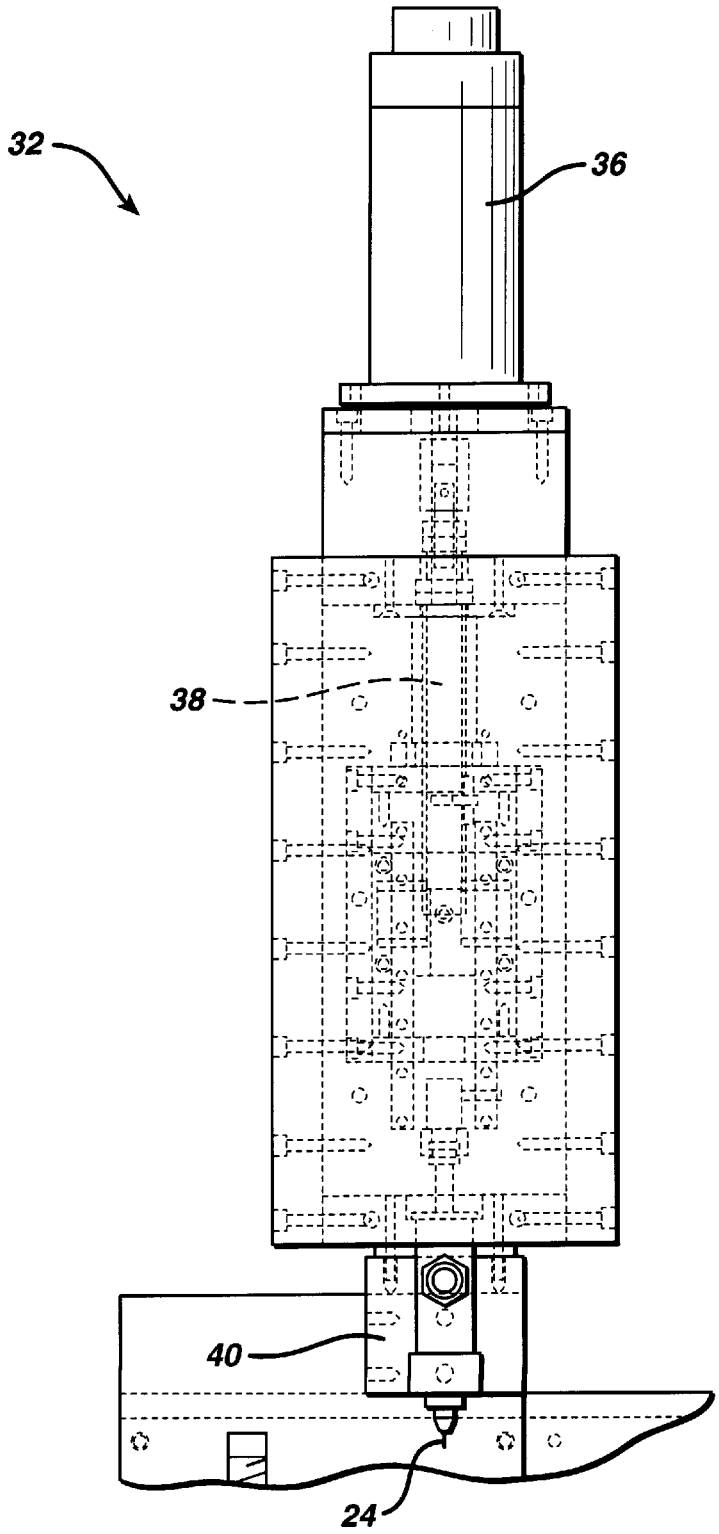
FIGS. 2*b* and 2*c* are enlarged detail side views of the upper and lower portions, respectively, of FIG. 2.
Figure 2C:
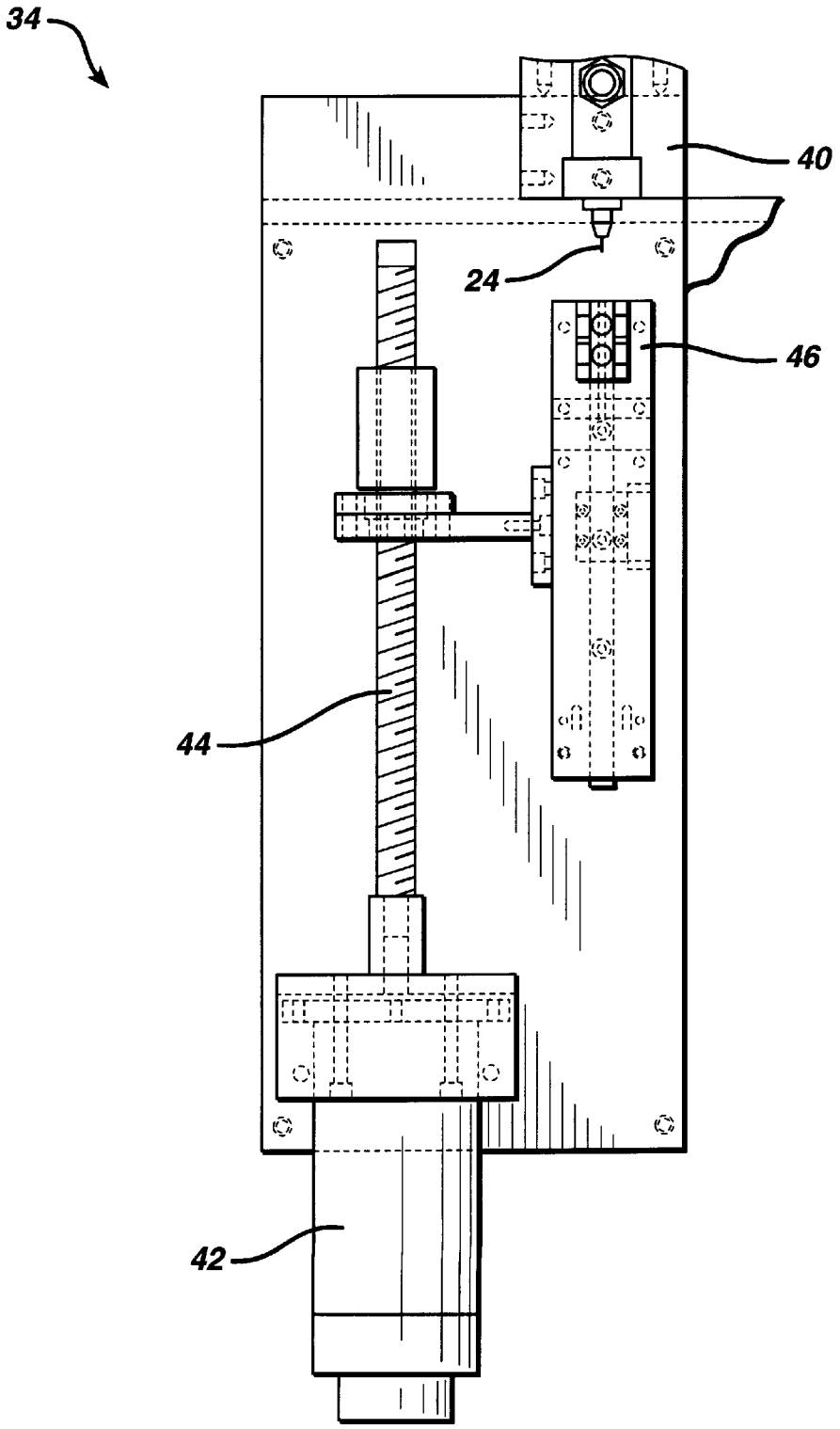

A suitable device 30 for use in the method of the invention is shown in FIGS. 2–2*c*. Device 30 includes a servo-controlled ink pump assembly 32, shown in detail in FIG. 2*b*, and a servo-controlled refill holder assembly 34, shown in detail in FIG. 2*c*. The ink pump assembly 32 controls rate of delivery of ink through the dispensing tube 24 into the reservoir 14, while the refill holder assembly 34 controls movement of the reservoir relative to the dispensing tube.

Ink pump assembly 32 includes a servomotor 36, a ball screw assembly 38, an ink pump 40, and dispensing tube 24, in fluid communication with the ink pump 40. Ball screw assembly 38 allows the ink pump piston to be moved vertically to dispense ink from the ink pump. Ball screw assembly 38 is controlled by servomotor 36.

Refill holder assembly 34 includes a servomotor 42, a ball screw assembly 44, and a refill holder 46. Ball screw assembly 44 allows the refill holder 46 to be moved vertically, controlled by servomotor 36.

Preferably, the ink is degassed prior to dispensing it into the reservoir. The ink may be degassed using known techniques, e.g., pulling a low vacuum in the mixer while the ink is being manufactured.

Other embodiments are within the claims. For example, while the method has been described with reference to ball point pens and ball point pen inks, other types of writing instruments and writing fluids, e.g., correction pens and correction fluids, can also be used. Moreover, the methods described above may be useful for dispensing other viscous fluids into other types of reservoirs or containers.

What is claimed is:

1. A method of dispensing a fluid into an elongated chamber having a bottom that is at least partially open, comprising:

(a) inserting a dispensing tube into the chamber until a delivery end of the tube is adjacent the bottom of the chamber;

(b) dispensing a predetermined quantity of the fluid through the delivery end into the chamber; and (c) causing the delivery end to move away from the bottom of the chamber, during dispensing, at a rate that maintains the delivery end within 0.5 mm or less of the surface of the fluid in the chamber throughout dispensing.

2. The method of claim 1 wherein the fluid is an ink or correction fluid.

3. The method of claim 1 wherein the fluid is a ball point pen ink.

4. The method of claim 1 wherein said chamber is cylindrical and has a diameter of less than about 10 mm.

5. The method of claim 4 wherein said diameter is from about 1 to 5 mm.

6. The method of claim 1 wherein the diameter of the tube is at least 70% of that of the chamber.

7. The method of claim 6 wherein the diameter of the tube is at least 90% of that of the chamber.

8. The method of claim 1 wherein the delivery end of the dispensing tube contacts the bottom of the chamber in step (a).

9. The method of claim 1 wherein the chamber is the reservoir of a ball point pen.

10. The method of claim 9 wherein the bottom of the chamber is defined by the ball of the ball point pen.

11. The method of claim 1 wherein the delivery end is maintained within 0.5 mm or less of the surface throughout dispensing.

12. The method of claim 1 further comprising the step of degassing the fluid prior to the dispensing step.

13. A method of dispensing a fluid into the reservoir of a writing instrument having a first end and a writing tip adjacent and in fluid communication with the first end, during manufacture of the writing instrument, comprising the sequential steps of:

(a) inserting a dispensing tube into the reservoir until a delivery end of the dispensing tube is adjacent the first end of the reservoir;

(b) dispensing a predetermined quantity of the fluid through the delivery end of the dispensing tube into the reservoir; and (c) degassing the fluid prior to the dispensing step.

14. The method of claim 13 wherein the first end of the writing instrument includes a ball point.

15. The method of claim 14 wherein the delivery end of the dispensing tube contacts the ball of the ball point during the inserting step.

16. The method of claim 13 further comprising, during the dispensing step, causing the delivery end to move away from the first end of the reservoir.

17. The method of claim 16 wherein the delivery end moves away from the first end at a rate that maintains the delivery end on the surface of the fluid in the reservoir throughout the dispensing step.

18. The method of claim 13 wherein the fluid is an ink or correction fluid.

19. The method of claim 18 wherein the fluid is a ball point pen ink.

20. A method of dispensing a fluid into an elongated chamber having a bottom that is at least partially closed, comprising:

(a) inserting a dispensing tube into the chamber until a delivery end of the tube is adjacent the bottom of the chamber;

(b) dispensing a predetermined quantity of the fluid through the delivery end into the chamber; and (c) causing the delivery end to move away from the bottom of the chamber, during dispensing, at a rate that maintains the delivery end at or slightly above the surface of the fluid in the chamber throughout dispensing; and (d) degassing the fluid prior to the dispensing step.

21. A method of dispensing a fluid into the reservoir of a writing instrument having a first end including a ball point and a writing tip adjacent and in fluid communication with the first end, during manufacture of the writing instrument, comprising the sequential steps of:

(a) inserting a dispensing tube into the reservoir until a delivery end of the dispensing tube is adjacent the first end of the reservoir and contacts the ball of the ball point; and (b) dispensing a predetermined quantity of the fluid through the delivery end of the dispensing tube into the reservoir.

* * * * *